United States Patent [19]

De Muro

[11] Patent Number: 5,023,866

[45] Date of Patent: Jun. 11, 1991

[54] DUPLEXER FILTER HAVING HARMONIC REJECTION TO CONTROL FLYBACK

[75] Inventor: David M. De Muro, Schaumburg, Ill.

[73] Assignee: Motorola, Inc., Schaumburg, Ill.

[21] Appl. No.: 355,844

[22] Filed: May 22, 1989

Related U.S. Application Data

[63] Continuation of Ser. No. 20,265, Feb. 27, 1987, abandoned.

[51] Int. Cl.[5] ..... H01P 1/202; H01P 1/205

[52] U.S. Cl. ..... 370/24; 333/205; 333/207; 333/202; 333/231; 370/30; 370/32

[58] Field of Search ..... 370/24, 30, 32; 379/59; 455/33 D; 333/202, 200, 205, 206, 208, 211, 212, 219, 227, 231, 236, 245, 242, 134–137; 334/42; 343/850, 905

[56] References Cited

U.S. PATENT DOCUMENTS

| | | | |
|---|---|---|---|
| 2,424,156 | 7/1947 | Espley . | |
| 2,760,057 | 8/1956 | Johannesen . | |
| 3,293,644 | 12/1966 | Loos et al. . | |
| 3,656,162 | 4/1972 | Mee | 343/180 |
| 3,662,294 | 5/1972 | Jacobs et al. | 333/33 |
| 3,728,731 | 4/1973 | Choi et al. | 343/180 |
| 3,735,289 | 5/1973 | Bruene | 333/5 |
| 3,815,137 | 6/1974 | Kaegebein | 343/180 |
| 4,080,601 | 5/1978 | Alcorn, Jr. | 343/180 |
| 4,255,729 | 3/1981 | Fukasawa et al. | 333/202 |
| 4,283,697 | 8/1981 | Masuda et al. | 333/202 |
| 4,431,977 | 2/1984 | Sokola et al. | 333/206 |
| 4,509,165 | 4/1985 | Tamura | 370/38 |
| 4,546,333 | 10/1985 | Fukasawa et al. | 333/202 |

OTHER PUBLICATIONS

Mishima et al., "Antenna and Duplexer for New Mobile Unit", E.C.L. Tech. Journal, NIT, Japan, vol. 31, No. 1, pp. 199–210, 1982.

*Primary Examiner*—Reinhard J. Eisenzopf
*Assistant Examiner*—L. Van Beek
*Attorney, Agent, or Firm*—Raymond A. Jenski; Rolland R. Hackbart

[57] ABSTRACT

A radio frequency duplexer filter for a duplex transceiver is disclosed. To prevent spurious signals conducted by flyback responses of the transmit bandpass filter 103 from reaching the antenna (105), a band reject circuit consisting of third harmonic quarter-wave transmission line stubs (601 and 603) are advantegeously coupled to an output transmission line (107). Likewise, to prevent spurious signals conducted by flyback responses of the receive bandpass filter (113) from reaching the receiver (109), a band reject circuit consisting of third harmonic quarter-wave transmission line stubs (605 and 607) are advantageously coupled to an input transmission line (111).

22 Claims, 6 Drawing Sheets

—PRIOR ART—

FIG. 2
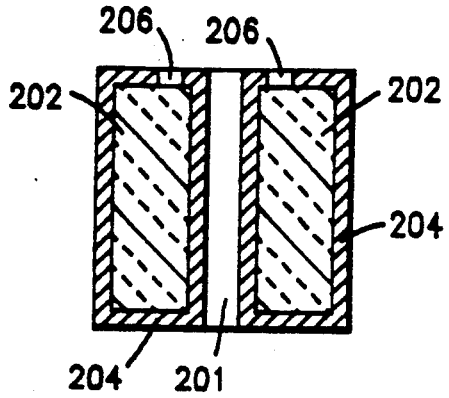
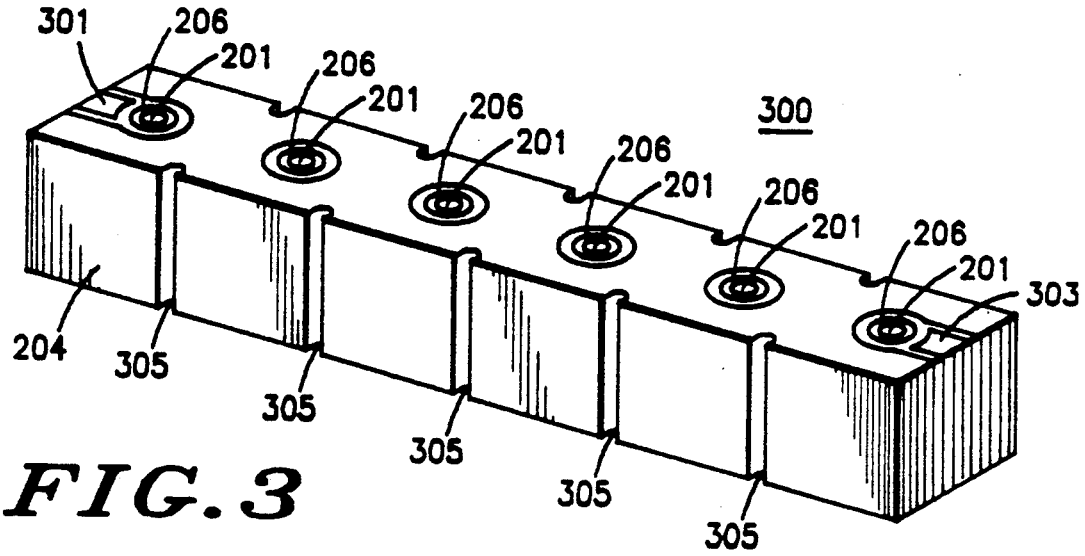
FIG. 3
FIG. 4
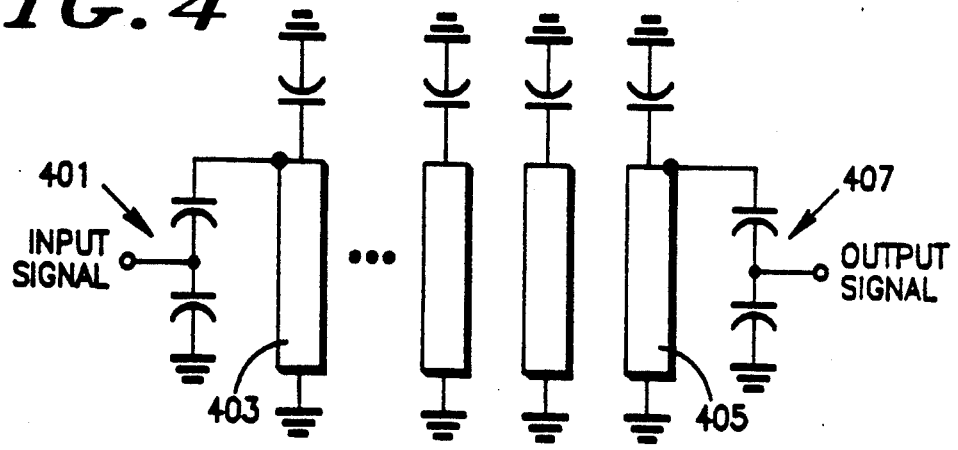

DUPLEXER FILTER HAVING HARMONIC REJECTION TO CONTROL FLYBACK

This is a continuation of application Ser. No. 020,265, filed Feb. 27, 1987, now abandoned.

BACKGROUND OF THE INVENTION

This invention relates generally to radio frequency filters and more particularly to duplexer radio frequency filters utilizing harmonic rejection to improve ultimate rejection outside of the bandpass regions.

In radio communication equipment employing both a receiver and a transmitter which may be operated simultaneously on separate but closely spaced frequencies and on a single antenna, a special radio frequency (RF) filter is generally employed to isolate the transmitter signal from the signal to be received by the receiver. The difference in power between the two signals typically is many orders of magnitude thus exceeding the dynamic range capability of linear receiver amplifiers which are not protected by a filter. Furthermore, consideration must also be given to the effects of noise and harmonics of each signal and the nonlinear effects of elements within the path of the two signals when designing a duplexer filter. These considerations have been addressed previously in earlier implementations of duplexers such as those described in U.S. Pat. Nos. 3,293,644 and 3,728,731.

Recent developments in ceramic resonators have produced duplexer filters which have significant advantages in size, cost, and performance over earlier implementations. Such filters are described further in U.S. Pat. application No. 656,121 ("Single Block Dual-Passband Ceramic Filter", filed on behalf of Kommrusch on Sept. 27, 1984), U.S. Pat. No. 890,682 (Multiple Resonator Component-Mountable Filter", filed on behalf of Moutrie et al. on July 25, 1986), and U.S. Pat. No. 890,686 ("Multiple Resonator Dielectric Filter", filed on behalf of Green et al. on July 25, 1986). Transmission line structures, which are the primary technology of these dielectrically loaded filters, have periodic frequency responses which produce passbands at frequencies related to the odd harmonics of the desired passband frequency (flyback). This flyback can result in spurious signal detection in the receiver or in the transmission of signals at undesired frequencies from the transmitter. Previous attempts at controlling flyback response in duplexing schemes have utilized a separate harmonic filter component between the duplexer filter and the common antenna.

SUMMARY OF THE INVENTION

Therefore, it is one object of the present invention to reduce flyback response of transmission line bandpass duplexer filters.

It is a further object of the present invention to provide harmonic signal rejection while reducing circuit complexity and insertion loss.

Accordingly, these and other objects are realized in the present invention which encompasses a radio frequency duplexer filter having at least one common and at least two independent electrical ports.

A means for selectively passing a first band of radio frequencies is coupled to one of the independent electrical ports and a means for selectively passing a second band of radio frequencies is coupled to another independent port. A means for rejecting a band of frequencies substantially equal to a harmonic of the first band of frequencies is coupled to the means for passing the first band of frequencies and a means for rejecting a band of frequencies substantially equal to a harmonic of the second band of frequencies is coupled to the means for passing the second band of frequencies.

BRIEF DESCRIPTION OF THE DRAWINGS

FIG. 2 is a cross-section of a dielectrically loaded coaxial resonator which may advantageously employ the present invention.

FIG. 3 is an isometric drawing of a plurality of dielectrically loaded coaxial resonators coupled to form a multi-resonator filter which may be advantageously employed in the present invention.

FIG. 4 is a schematic diagram of the filter of FIG. 3.

DESCRIPTION OF THE PREFERRED EMBODIMENT

Figure 1:
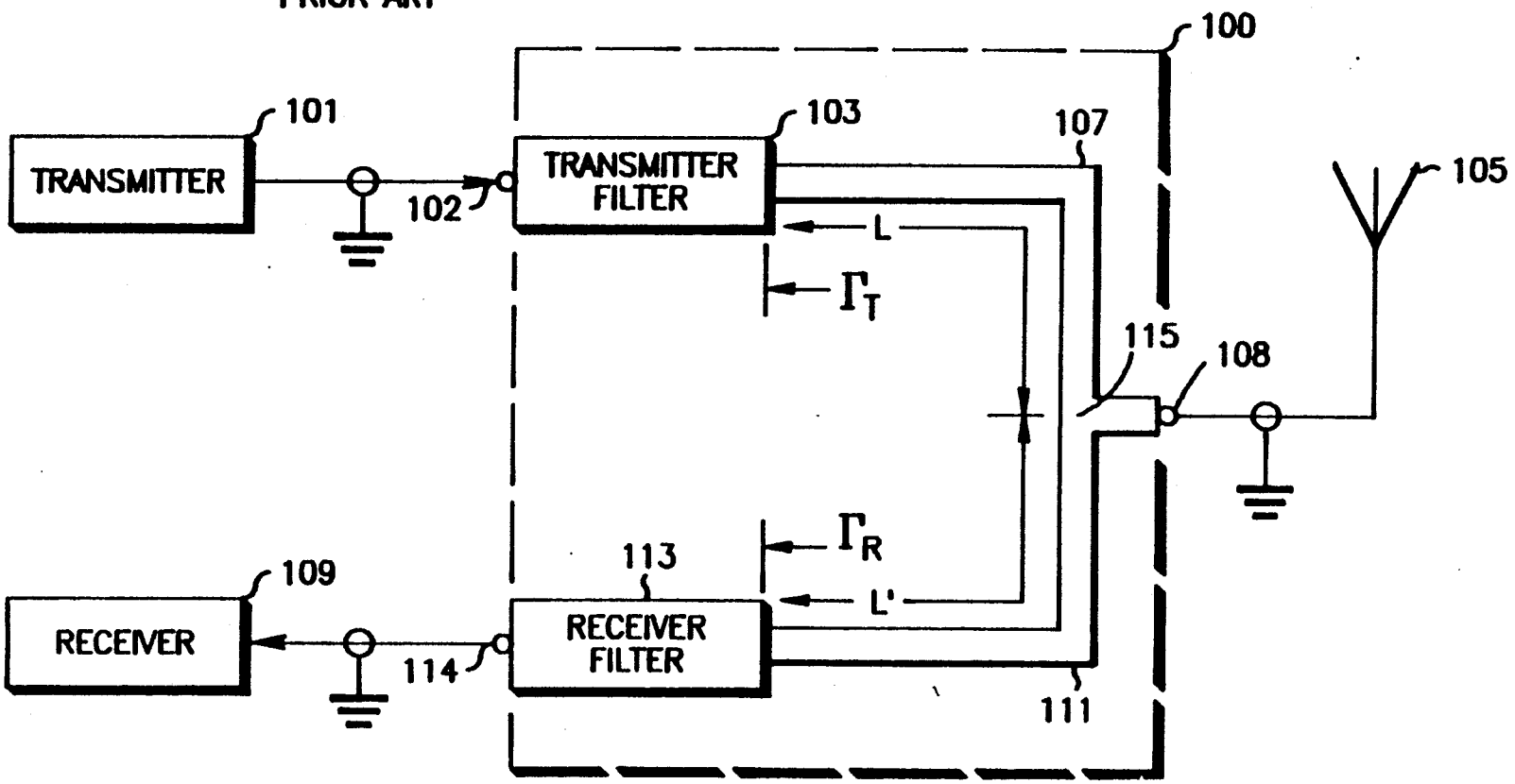
FIG. 1 is a block diagram of a conventional duplexer filter.

FIG. 1 is a block diagram illustrating a conventional duplexer filter 100 for a simultaneously operating transmitter and receiver. Here, a transmitter 101 is coupled via an independent input port 102 to a transmit filter 103 which, in turn, is coupled to an antenna 105 through a transmission line 107 having a length L and a common port 108. A radio receiver 109 receives signals from the antenna 105 via the common port 108 and a transmission line 111 having length L' and coupled to the receive filter 113. The output of the receive filter 113 is coupled to the receiver 109 via independent output port 114. Since the transmitter 101 and the receiver 109 in applications such as in mobile and portable radiotelephone equipment must operate simultaneously, it is necessary that the high power signal from the transmitter 101 be decoupled from the generally weak signal to be received by the receiver 109. Typically, the transmitter 101 and the receiver 109 operate at frequencies which are separated from each other by a relatively small amount of frequency difference. For example, in those frequency bands normally employed in mobile radiotelephone services, the difference in frequencies between the transmit and receive frequency is between one and ten percent of the operating frequency band. Thus, it is possible to build a transmit filter 103 and a receiver filter 113 which have characteristics such that the transmit filter 103 passes those frequencies which the transmitter 101 may generate and transmit while rejecting those frequencies which the receiver 109 may be tuned to receive. Likewise, the receiver filter 113 may be tuned to pass those frequencies which may be received by receiver 109 while rejecting those frequencies which may be transmitted by transmitter 101. Furthermore, the transmit filter 103 may be designed to reject or block harmonics of the frequencies which are generated by transmitter 101 so that these harmonic frequencies are not radiated by the antenna 105. Also, the receive filter 113 may be designed to block frequencies which may be converted by a superheterodyne receiver into on channel frequencies (image frequencies) and also block harmonics of the frequencies to which receiver 109 is normally tuned.

Good engineering design of the transmit filter 103 and the receive filter 113 produce filters having a reflection coefficient ($\Gamma$) which is as low as possible at the frequency to which the respective filter is tuned (indicative of an impedance match to the transmission lines 107 and 111 respectively). Thus, the $\Gamma_T$ of the transmit filter 103 is designed to be near zero at the transmit frequency and some other non-zero value at other frequencies such as the receive frequency. Similarly, the receive filter $\Gamma_R$ is designed to be near zero at the receive frequencies and some other non-zero value at other frequencies such as the transmit frequencies.

To advantageously use the non-zero reflection coefficient the length L of transmission line 107, then, is designed to be a quarter wavelength long at the receive frequencies and the length of transmission line 111, L', is designed to be a quarter wavelength at the transmit frequencies. The quarter wavelength transmission lines 107 and 111 transform the respective reflection coefficients (which are usually short circuits at the receive and transmit frequencies respectively) to near open circuits (at the respective receive and transmit frequencies) at the duplex junction point 115 of the duplexer. In this way, receiver frequency energy from the antenna 105 which propogates down transmission line 107 is reflected back from the transmit filter 103 and combined in-phase with the receiver frequency energy propogating down transmission line 111 thus yielding a minimum insertion loss between the duplex point 115 and the receiver 109. Likewise, a reflection of transmit energy which propagates down transmission line 111 from the receive filter 113 combines in-phase at the duplex point 115 with the energy coming directly from the transmit filter 103 to yield a minimum of insertion loss between the input of transmit filter 103 and the duplex point 115.

The transmit filter 103 and the receiver filter 113 have been realized using many different filter technologies. In order to realize small filter size without sacrificing filter performance, designers have turned to dielectrically loaded transmission line technologies to optimize performance. One such filter is further described in U.S. Pat. No. 4,431,977 which utilizes ceramic dielectric coupled in such a fashion to realize a bandpass filter. A typical ceramic dielectric filter is shown in cross-section in FIG. 2. In FIG. 2, a center resonating structure 201 is surrounded by a ceramic dielectric 202 which, in turn, is surrounded by a conductive material 204 which provides both the ground for the transmission line structure and shielding of the resonating element 201. On a top surface of the resonator, a gap 206 may exist between the high electric field of resonator 201 and the conductive material 204. A filter typically is made up of a plurality of such transmission line resonating structures and may be of a plurality of individual resonators coupled by external electrical components or may be electromagnetically coupled via gaps in the conductive material 204. Such a coupled filter is shown in a filter block 300 in FIG. 3 and is further described in U.S. Pat. No. 4,431,977.

The filter block 300 of FIG. 3 is covered or plated with an electrically conductive material 204 with the exception of the gaps 206. As shown, the filter block 300 includes six holes which extend from the top surface to the bottom surface of the filter block. (The number of holes is determined by the particular requirements of the filter). The internal surface of each hole is plated with a conductive material and forms a foreshortened coaxial resonator having a length selected for the desired filter response characteristics and frequency. Input and output electrodes 301 and 303 are provided on the top surface of the filter block 300 to couple energy into and out of the filter. Furthermore, coupling between the coaxial resonator holes is accomplished through the dielectric material and is varied by varying the width of the dielectric material, the distance between adjacent coaxial resonators, and the depth of notches 305 (if used) defining the boundaries of each resonator.

Referring to FIG. 4, there is illustrated an equivalent circuit diagram for a coupled dielectric bandpass filter such as that shown in FIG. 3. An input signal from a signal source (such as a transmitter in a transmit bandpass filter configuration or an antenna in a receiver filter bandpass configuration) may be applied to the input 401 of the filter. Capacitive matching at the input 401, which is accomplished by the input electrode 301 of the filter block 300, transforms the input signal impedance to the desired impedance at the first resonator 403. Energy may then be coupled in conventional fashion between the resonators until an output signal is coupled from the output resonator 405 via capacitive matching network 407 realized by output electrode 303 of filter block 300.

Figure 5:
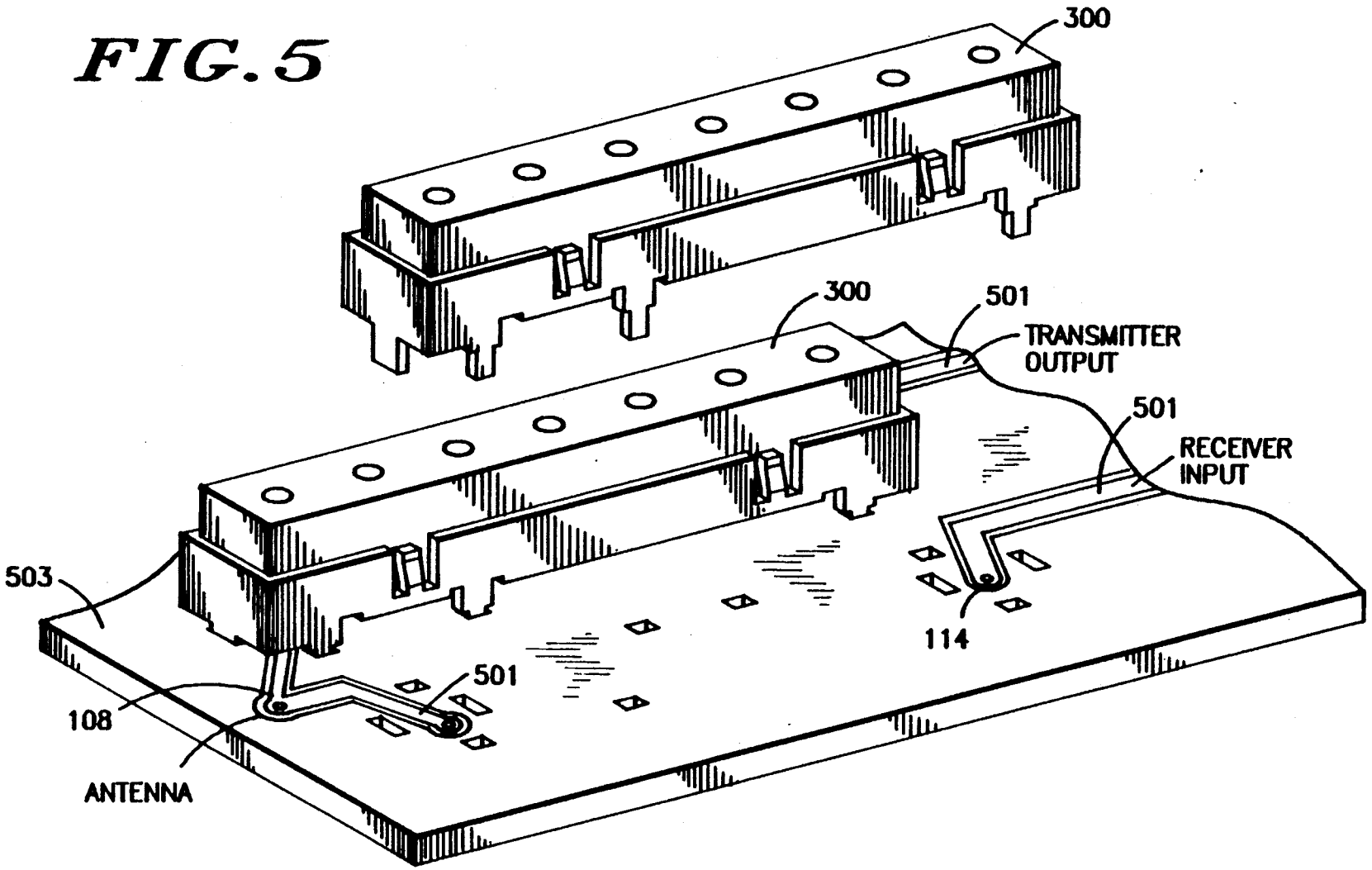
FIG. 5 is an isometric drawing of two filters such as those of FIG. 3 arranged in a duplexer circuit board mounted configuration.

Two such ceramic block filters 300 may be coupled as shown in FIG. 5 to form a duplexer. Two filters, one tuned as a transmit bandpass filter and another tuned as a receive bandpass filter can be electrically coupled via transmission lines 501 on a multilayered printed circuit board 503 or other medium, to couple the transmitter output to an antenna and to couple an antenna to a receiver input. As shown in FIG. 5, the transmission lines 501 are microstrip lines created by conductors disposed on the top of printed circuit board 503 and a conductive ground plane disposed on the bottom of printed circuit board 503. Other forms of transmission line, such as stripline transmission line formed by two conductive layers of a multilayer printed circuit board, can be employed in realizing the present invention. A duplexer employing component-mountable filter blocks on a printed circuit board is further described in U.S. Pat. application No. 890,686 ("Multiple Resonator Dielectric Filter", filed on July 25, 1986 on behalf of Green et al.) and U.S. Pat. application No. 890,682 ("Multiple Resonator Component-Mountable Filter", filed on July 25, 1986 on behalf of Moutrie et al.).

Since coaxial resonators and other periodically resonant transmission line filters exhibit flyback frequency responses at or near the odd harmonics of the passband frequencies, signals generated by the transmitter 101 of FIG. 1 having odd harmonic components may pass through the transmit bandpass filter 103 without sufficient attenuation. Likewise, odd harmonics of the desired receiver frequencies may pass from the antenna 105 through the receiver bandpass filter 113 to the receiver 109 without sufficient attenuation. As a specific example, a mobile transceiver operating at transmit frequencies of approximately 900 MHz will have a transmit bandpass filter 103 tuned to pass all the transmit frequencies around 900 MHz. A flyback response of the periodically resonant coaxial resonators of a filter block such as filter block 300 employed as a transmit bandpass filter 103 will pass harmonic frequencies at approximately 2700 MHz. The receiver of a mobile transceiver may operate at a plurality of receive frequencies around 855 MHz and will have a receive bandpass filter 113 tuned to pass all the receive frequencies around 855 MHz. A flyback response of the periodically resonant coaxial resonators of a filter block 300 tuned to the receive frequencies as receive bandpass filter 113 will occur at approximately 2565 MHz. In both transmit and receive filters, it is desirable to prevent the flyback responses from passing spurious signals which occur at the harmonics of the desired signals.

It is an important feature of the present invention, then, that protection against flyback responses of the periodic transmission line filters such as those realized in filter block 300. In the present invention, additional transmission lines are added to those transmission lines coupling the transmit bandpass filter 103 to the antenna 105 (transmission line 107), and coupling the antenna 105 to the receive bandpass filter 113 (transmission line 111). Thus, the transmission lines 107 and 111 are modified in a preferred embodiment as shown in FIG. 6.

Figure 6:
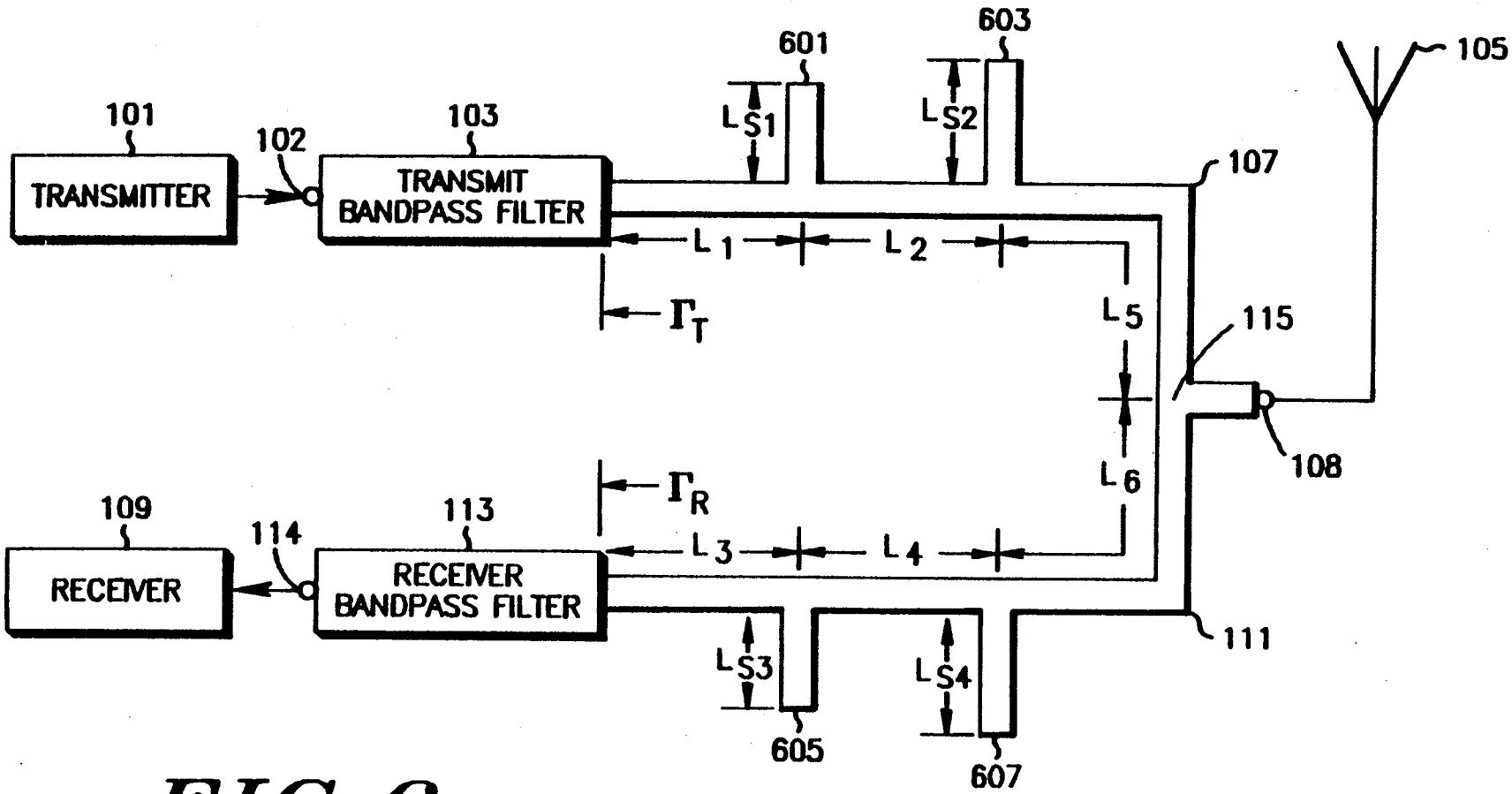
FIG. 6 is a block diagram of a duplexer employing the present invention.

In FIG. 6, the transmission lines 107 and 111 have open circuited stubs added at predetermined places. In the preferred embodiment of the transmitter leg of a duplexer filter, transmit transmission line 107 consists of a 50 Ohm transmission line and open circuited transmission line stubs 601 (having an electrical length of $L_{s1}$) and 603 (having electrical length $L_{s2}$). Stub 601 is an open circuited length of 70 Ohm (characteristic impedance) transmission line essentially one quarter wavelength long at 2700 MHz. Since the effect of an open-circuited quarter wavelength transmission line at the frequency of the quarter wavelength is to transform the high-impedance open circuit to a low-impedance short circuit, a short circuit notch at 2700 MHz results in the frequency response of transmission line 107. That is, third harmonic energy from transmitter 101 passed by the flyback response of transmit bandpass filter 103 is blocked by the short circuit created by the 2700 MHz quarter wavelength stub 601. Stub 601 provides a short circuit notch over a band of frequencies theoretically equal to 200 MHz. If the transmit bandpass filter 103 has a passband of 25 MHz and the transmitter 101 operates over a band of frequencies equal to 25 MHz, it appears that the notch produced by stub 601 would be effective over the full 75 MHz third harmonic of the passband of transmitter bandpass filter 103. This is not the case in practice, however. Variations in the line dimensions and dielectric constant of the circuit board cause the center frequency of the notch to vary. Thus, in the preferred embodiment, a second stub 603 is necessary to increase the bandwidth over which third harmonic rejection is realized in the transmitter leg of the duplexer filter. Two stubs provide a −26dB bandwidth over approximately 400 MHz.

Stub 603 is also an open-circuited length of 70 Ohm transmission line essentially one-fourth wavelength long at 2700 MHz. In the preferred embodiment, stub 603 is tuned to be a quarter wavelength long at 2607 MHz and stub 601 is tuned to be a quarter wavelength long at 2807 MHz. Thus, the specific lengths are chosen to provide two notches in the frequency response of the overall transmission line coupling the transmit bandpass filter 103 to the antenna 105. When combined, the notches produced by stub 601 and stub 603 are spaced so that a specified amount of rejection (26 dB in the preferred embodiment) is achieved over the band of third harmonic frequencies that the transmit filter exhibits flyback. Additional transmission line stubs may be added to further increase the effective notch frequency width. Furthermore, transmission line stubs providing a short circuit notch at other odd harmonic frequencies (e.g. fifth, seventh, etc. harmonic) may also be advantageously utilized in the present invention.

Since the open circuit stubs 601 and 603 present an inductive reactance of approximately 90 Ohms to the transmission line 107 at the fundamental frequency, this reactance degrades, the return loss (SWR) of line 107 at the fundamental frequency. To prevent this, the characteristic impedance of transmission line 107 is increased to 70 Ohms over the length $L_2$ between stubs 601 and 603. The reactance of the narrowed line offsets the reactance of stubs 601 and 603 so that the SWR and insertion loss of line 107 are improved at 900 MHz. Lengths $L_1$ and $L_5$ are 50 Ohm lines whose lengths are determined as follows: the structure consisting of stubs 601 and 603 and transmission line length $L_2$ will have some phase shift at the receive frequency. The overall phase shift at the receive frequency provided by line 107 must be such that an open circuit at the receive frequency is achieved at the duplex point 11. Line lengths $L_1$ and $L_5$ must provide the remaining phase shift not provided by $L_2$ and stubs 601 and 603. Only the sum total length $L_1+L_5$ is determined; the lengths can be distributed in any manner between $L_1$ and $L_5$, provided that the total electrical length of $L_1+L_5$ is correct. The design process can be summarized in the following steps: 1) Stub lengths $L_{s1}$ and $L_{s2}$ are chosen to be ¼ wavelength long at three times the fundamental frequency. 2) The Length and width of $L_2$ are chosen to minimize the SWR and insertion loss with the stubs in place. 3) The required phase shift for the total line 107 is determined based on the out of band reflection coefficient of the bandpass filter 103. 4) The phase shift provided by $L_2$ with stubs 601 and 603 in place is either measured or determined by computer analysis. 5) The remaining phase shift needed, as determined in steps 3 and 4, is provided with 50 Ohm transmisison lines $L_1$ and $L_5$. The sum total length $L_1+L_5$ can be read off a Smith Chart once the desired electrical length is known. This length can be distributed between $L_1$ and $L_5$ in any manner that is mechanically desirable. Thus, the total phase shift at the receive frequency of the line 107 is such that minimal loading to the receive path is provided.

The transmission line coupling the antenna 105 to the receive bandpass filter 113 is similarly constructed. Open circuit transmission line stubs 605 and 607, realized by 70 Ohm stripline transmission lines, are tuned to approximately one quarter wavelength at the third harmonic of the band of frequencies passed by the receive bandpass filter 113. Transmission line stub 605 has an electrical length of $L_{s3}$ and transmission line stub 607 has an electrical length of $L_{s4}$, each chosen to produce a notch in the frequency response of the transmission line coupling the antenna 105 to the receive bandpass filter 113. Like the notch produced in the transmit leg of the present invention, the sum of the notch width (−26 dB) is approximately 400 MHz to allow for manufacturing tolerances. The length of transmission line $L_4$, a 70 Ohm section between stubs 605 and 607, is chosen to notch the 90 Ohm inductive reactance of the receive bandpass filter 113 to the 50 Ohm duplex point impedance at the fundamental frequency. The length of transmission lines $L_3$ and $L_6$ are chosen in the same manner as $L_1$ and $L_5$ in the transmitter leg.

Figure 7:
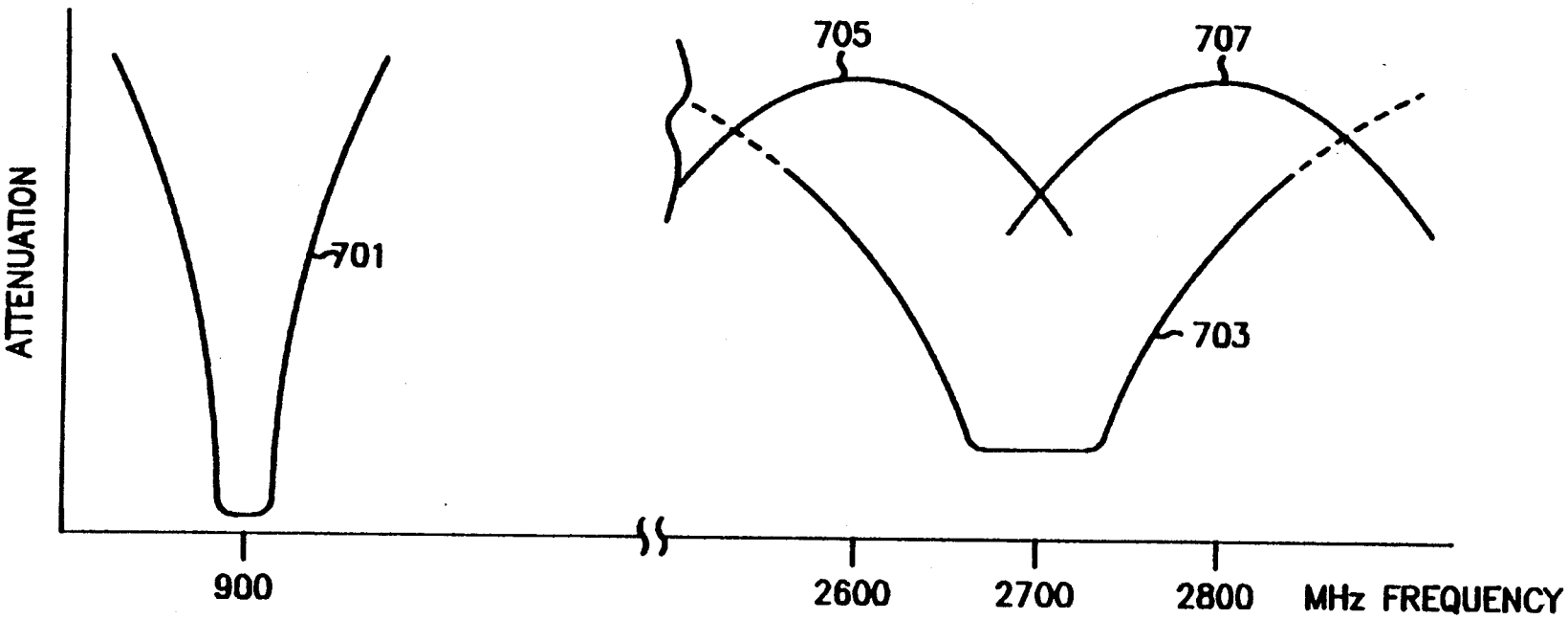
FIG. 7 is attenuation versus frequency graph illustrating the frequency response of one leg of the duplexer of FIG. 6.

A generalized attenuation versus frequency graph of the frequency response of the transmit leg of the duplexer filter is shown in FIG. 7. (An equivalent graph may be drawn for the receive leg of the duplexer, but is not drawn here for brevity). Here, the desired passband of frequencies, such as that which may be passed by the transmit bandpass filter 103 (or the receive bandpass filter 113) is shown as the low attenuation bandpass curve 701 centered around 900 MHz. AT around 2700 MHz, another minima of attenuation is realized by the transmission line bandpass filter structure shown as curve 703. In order to reduce the effect of the flyback at 2700 MHz, maxima of attenuation (shown as curves 705 and 707) are produced by the open circuit stubs (603 and 601, respectively) of the present invention. Thus, rejection of frequencies outside the desired bandpass is assured by short circuiting any flyback at the odd harmonics with the rejection of open circuit transmission line stubs.

Figure 8:
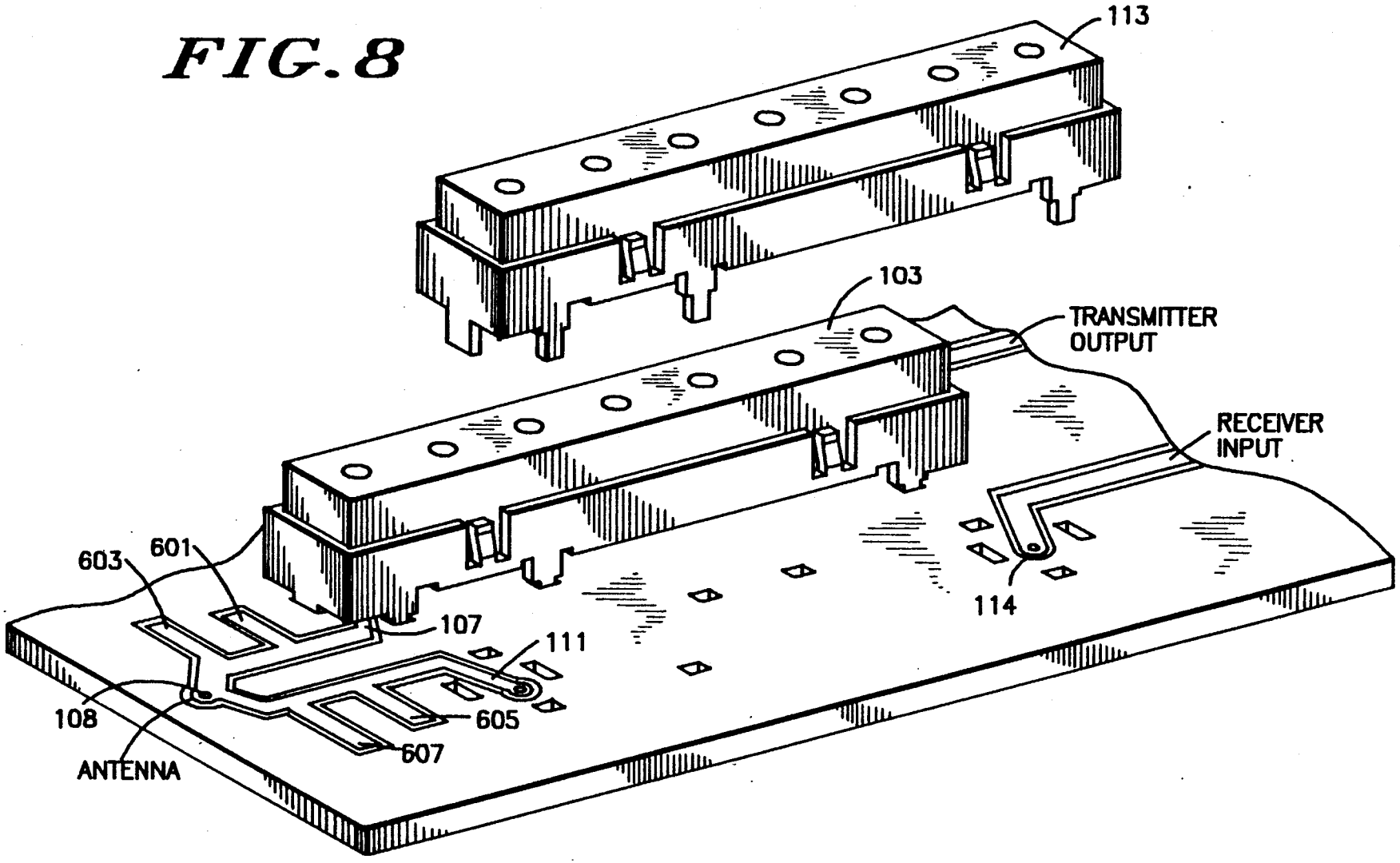
FIG. 8 is an isometric drawing of two bandpass filters arranged in a circuit board mounted duplexer configuration and employing the present invention.

In one physical implementation of the preferred embodiment, such as that shown in FIG. 8, the transmit bandpass filter 103 is tuned to pass the band of frequencies between 890 MHz and 915 MHz. Therefore, the band at which third harmonic rejection is required extends between 2670 MHz and 2745 MHz. In order to realize a rejection of 26 dB in a stripline configuration on FR-4 printed circuit board material having a dielectric constant of 4.6±0.4, 70 Ohm transmission line stubs were used. The length of transmission stub 601 ($L_{s1}$) was 1.21 centimeters of 0.25 millimeter width with copper of thickness equal to 0.035 millimeters. This equates to an electrical length of 2.59 centimeters. The length $L_{s2}$ of stub 603 was calculated to be 1.36 centimeters, equal to an electrical length of 2.59 centimeters. These stubs 601 and 603 are separated by 70 Ohm transmission line (0.25 millimeters width of 0.035 millimeter copper). The 50 Ohm transmission line length from the transmit bandpass filter 103 to the stub 601 ($L_1$) was selected to be 1.24 centimeters (electrical length of 2.66 centimeters). The length of transmission line ($L_2$) between stub 603 was calculated to be 1.91 centimeters, an electrical length of 4.1 centimeters.

A similar set of calculations performed for the receive transmission line and stubs yielded a stub 605 length ($L_{s3}$) of 1.09 centimeters or an electrical length of 2.34 centimeters. The length of stub 607 ($L_{s4}$) was calculated to be 1.21 centimeters for an electrical length of 2.59 centimeters. Stubs 605 and 607 are separated by a 70 Ohm transmission length ($L_4$) of 1.55 centimeters. In the preferred embodiment, the distance from the receive bandpass filter 113 and stub 605 ($L_3$) and from stub 607 to the duplex point 115 ($L_6$) are calculated to be 0.87 centimeters each, an electrical length of 1.87 centimeters each.

In summary, then, a duplexer employing transmission line stubs tuned to the third harmonic of the band of frequencies being passed in the associated bandpass filter to negate the effects of flyback have been shown and described. Therefore, while a particular embodiment of the invention has been shown and described, it should be understood that the invention is not limited thereto since modifications unrelated to the true spirit and scope of the invention may be made by those skilled in the art.

I claim:

1. A duplexer filter for a duplex radio communications transceiver comprising:

first periodically resonant means tuned to pass a band of frequencies utilized by the radio transmitter;

second periodically resonant means tuned to pass a band of frequencies utilized by the radio receiver;

a first transmission line coupling said first periodically resonant means to an antenna port, having a length determined by a phase shift necessary to produce an essentially open circuit at said antenna port at said band of frequencies utilized by the radio receiver, and having at least one open-circuited stub with a length substantially equal to one-fourth the electrical wavelength of the third harmonic of a frequency within said band of frequencies utilized by the transmitter; and a second transmission line coupling said second periodically resonant means to said antenna port, having a length determined by a phase shift necessary to produce an essentially open circuit at said antenna port at said band of frequencies utilized by the radio transmitter, and having at least one open-circuited stub with a length substantially equal to one-fourth the electrical wavelength of the third harmonic of a frequency within said band of frequencies utilized by the receiver.

2. A duplexer filter in accordance with claim 1 wherein said first and second transmission lines further comprise microstrip transmission lines realized as copper conductors over a ground plane of a printed circuit board.

3. A duplexer filter in accordance with claim 1 wherein said first and second transmission lines further comprise stripline transmission lines realized as copper conductors between ground planes of a printed circuit board.

4. A radio frequency duplexer for a cellular telephone transceiver selectively coupling a transmitter to an antenna and selectively coupling the antenna to a receiver, comprising:

a first bandpass filter of a plurality of periodically resonant structures tuned to a first band of frequencies and coupled to the transmitter whereby signals within said first band of frequencies may be passed by said first bandpass filter;

a first transmission line having an input end and an output end and a first length and coupling said first bandpass filter at said input end to a duplex point at said output end to which the antenna may be coupled, said first length determined by a phase shift necessary to produce an open circuit at a second band of frequencies at said duplex point;

a first open-circuited transmission line stub having a first characteristic impedance and a first stub length and coupled to said first transmission line at a place being a first distance from said first transmission line input end;

a second open-circuited transmission line stub having a second characteristic impedance and a second stub length and coupled to said first transmission line a second distance from said place said first stub is coupled to said first transmission line;

a second bandpass filter of a plurality of periodically resonant structure tuned to said second band of frequencies and coupled to the receiver whereby signals within said second band of frequencies may be passed by said second bandpass filter;

a second transmission line having an input end, an output end, and a second length and coupling said second bandpass filter at said output end to said duplex point at said input end, said second length determined by a phase shift necessary to produce an open circuit at said first band of frequencies at said duplex point;

a third open-circuited transmission line stub having a third characteristic impedance and a third stub length and coupled to said second transmission line at a place being a third distance from said second transmission line output end; and a fourth open-circuited transmission line stub having a fourth characteristic impedance and a fourth stub length and coupled to said second transmission line a fourth distance from said place said third stub is coupled to said second transmission line.

5. A radio frequency duplexer in accordance With claim 4 wherein said first transmission line predetermined length further comprises the sum of said first distance, said second distance, and a fifth distance.

6. A radio frequency duplexer in accordance with claim 5 wherein the sum of said first distance and said fifth distance is a constant.

7. A radio frequency duplexer in accordance with claim 5 wherein said first transmission line further comprises a transmission line having a fifth characteristic impedance over said first distance and said fifth distance and having a sixth characteristic impedance over said second distance.

8. A radio frequency duplexer in accordance with claim 4 wherein said second transmission line predetermined length further comprises the sum of said third distance, said fourth distance, and a sixth distance.

9. A radio frequency duplexer in accordance with claim 8 wherein the sum of said third distance and said sixth distance is a constant.

10. A radio frequency duplexer in accordance with claim 8 wherein said second transmission line further comprises a transmission line having a seventh characteristic impedance over said third distance and said sixth distance and having an eighth characteristic impedance over said fourth distance.

11. A radio frequency duplexer in accordance with claim 4 wherein said first stub length is substantially equal to one-fourth the electrical wavelength of the third harmonic of a frequency above said first band of frequencies.

12. A radio frequency duplexer in accordance with claim 4 wherein said second stub length is substantially equal to one-fourth the electrical wavelength of the third harmonic of a frequency below said second band of frequencies.

13. A radio frequency duplexer in accordance with claim 4 wherein said third stub length is substantially equal to one-fourth the electrical wavelength of the third harmonic of a frequency above said second band of frequencies.

14. A radio frequency duplexer in accordance with claim 4 wherein said fourth stub length is substantially equal to one-fourth the electrical wavelength of the third harmonic of a frequency below said second band of frequencies.

15. A radio frequency duplexer in accordance with claim 4 wherein said first and second transmission lines further comprise microstrip transmission lines realized as copper conductors over a ground plane of a printed circuit board.

16. A radio frequency duplexer in accordance with claim 4 wherein said first and second transmission lines further comprise stripline transmission lines realized as copper conductors between ground planes of a printed circuit board.

17. A duplexer filter for a duplex radio communications transceiver comprising:

first periodically resonant means tuned to pass a band of frequencies utilized by the radio transmitter;

second periodically resonant means tuned to pass a band of frequencies utilized by the radio receiver;

a first transmission line coupling said first periodically resonant means to an antenna port, having a length determined by a phase shift necessary to produce an essentially open circuit at said antenna port at said band of frequencies utilized by the radio receiver, and having at least one open-circuited stub with a length substantially equal to one-fourth the electrical wavelength of the third harmonic of a frequency within said band of frequencies utilized by the radio transmitter; and a second transmission line coupling said second periodically resonant means to said antenna port and having a length determined by a phase shift necessary to produce an essentially open circuit at said antenna port at said band of frequencies utilized by the radio transmitter.

18. A duplexer filter in accordance with claim 17 wherein said first and second transmission lines further comprise microstrip transmission lines realized as copper conductors over a ground plane of a printed circuit board.

19. A duplexer filter in accordance with claim 17 wherein said first and second transmission lines further comprise stripline transmission lines realized as copper conductors between ground planes of a printed circuit board.

20. A duplexer filter for a duplex radio communications transceiver comprising:

first periodically resonant means tuned to pass a band of frequencies utilized by the radio transmitter;

second periodically resonant means tuned to pass a band of frequencies utilized by the radio receiver;

a first transmission line coupling said first periodically resonant means to an antenna port and having a length determined by a phase shift necessary to produce an essentially open circuit at said antenna port at said band of frequencies utilized by the radio receiver; and a second transmission line coupling said second periodically resonant means to said antenna port, having a length determined by a phase shift necessary to produce an essentially open circuit at said antenna port at said band of frequencies utilized by the radio transmitter, and having at least one open-circuited stub with a length substantially equal to one-fourth the electrical wavelength of the third harmonic of a frequency within said band of frequencies utilized by the radio receiver.

21. A duplexer filter in accordance with claim 20 wherein said first and second transmission lines further comprise microstrip transmission lines realized as copper conductors over a ground plane of a printed circuit board.

22. A duplexer filter in accordance with claim 20 wherein said first and second transmission lines further comprise stripline transmission lines realized as copper conductors between ground planes of a printed circuit board.

* * * * *